US005492748A

United States Patent [19]

Thuswaldner et al.

[11] Patent Number: 5,492,748

[45] Date of Patent: Feb. 20, 1996

[54] CAMOUFLAGE NETTING

[75] Inventors: Hermann Thuswaldner; Sören Andersson, both of Gamleby, Sweden

[73] Assignee: Barracuda Technologies AB, Sweden

[21] Appl. No.: 690,999

[22] PCT Filed: Nov. 6, 1990

[86] PCT No.: PCT/SE90/00719

§ 371 Date: Jun. 28, 1991

§ 102(e) Date: Jun. 28, 1991

[87] PCT Pub. No.: WO91/06822

PCT Pub. Date: May 16, 1991

[30] Foreign Application Priority Data

Nov. 6, 1987 [SE] Sweden ..... 8903709

[51] Int. Cl.[6] ..... B32B 5/12

[52] U.S. Cl. ..... 428/109; 428/105; 428/919

[58] Field of Search ..... 428/100, 105, 428/109, 919

[56] References Cited

FOREIGN PATENT DOCUMENTS

| | | |
|---|---|---|
| 50967 | 5/1941 | France . |
| 2078799 | 1/1982 | United Kingdom . |

*Primary Examiner*—James J. Bell

*Attorney, Agent, or Firm*—Lee, Mann, Smith, McWilliams, Sweeney & Ohlson

[57] ABSTRACT

According to the invention, a web of material presenting periodic string Darts is provided with garnishing material by forming loops of garnishing material around the net yarn, and subsequently fastening the loops together, preferably by applying high frequency energy. This is preferably effected in an automatic machine, in which string parts together with accompanying garnishing are inserted into apertures formed on a drum by means of electrodes which are mutually separated during the process of insertion and which are then clamped together and supplied with high frequency energy, where after the electrodes are again separated to release the string material and garnishing.

1 Claim, 5 Drawing Sheets

CAMOUFLAGE NETTING

The present invention relates to a camouflage net of the kind which comprises a foil which includes garnishing material and is attached at least sporadically to a net framework.

Such camouflage nets are known per se, in which leaf-cut material or material which has been perforated in some other way is attached to a net structure. One example of leaf-cut material is illustrated in U.S. Pat. No. 3,069,796. Material which has been cut in this way can be attached to a net either in the form of differently coloured tags or scraps or in the form of broad strips. The material is normally attached by applying glue to the net, which joins the net to the garnishing material applied thereto.

One particular desideratum in this respect is that the camouflaging net will give a three-dimensional effect, as far as possible. Although a leaf-cut material of the aforesaid kind will develop or extend into a three-dimensional configuration, the material is flattened, at times to a significant extent, as it is being attached to the net structure. As a result, when the net is viewed from an oblique angle, the preference direction of the net may become evident to an excessively large degree, so that even though the garnishing material has a matte surface, the reflectivity obtained will be excessively high.

Two different methods of attachment are at present used to this end, namely attachment by gluing and attachment with the aid of separate attachment devices. When attaching the garnishing material with the aid of an adhesive, the net is first coated with an adhesive and the garnishing material then applied to said net, this material fixed to the net as the adhesive sets. As the adhesive sets or hardens, it normally releases a solvent, which is a disadvantage. Another drawback is that when using leaf-cut material in order to obtain a three-dimensional effect, this effect is impaired by the fact that the garnishing material is placed too tightly against the net.

The garnishing material may also be attached to the net with the aid of fastener devices, normally with the use of hand-operated fastener devices, and consequently the costs entailed hereby are high.

It is an object of the invention to provide an improved and controlled spatial effect in camouflage nets of the kind described in the introduction. This and other objects of the invention and advantages afforded thereby are achieved, in accordance with the invention, by attaching the garnishing material to the net structure by placing garnishing-material foil in a loop around yarn parts of the net at discrete or mutually spaced locations and by mutually joining each loop thus formed at the beginning and end of said loop, calculated in relation to respective yarn parts. This attachment of the garnishing material is thus carried out purely locally and at mutually separated locations, and can be effected with the aid of ultrasound, HF-welding, impulse welding or gluing. This enables a controlled spatial effect to be achieved, determined by the amount of garnishing material located between the different attachment points, which can be placed sufficiently close together so that the form taken will be relatively well determined.

In accordance with a preferred aspect of the invention, the invention also relates to a method of achieving such attachment of the garnishing material in a particularly inexpensive and rational manner. This object is achieved in accordance with one aspect of the invention by an attachment method which uses high frequency energy and with the aid of a device.

When applying the inventive method, the garnishing material can thus be attached by permitting stretched so-called string parts in the reinforcing web material to press garnishing material down into apertures formed in a device and defined on both sides by electrodes, which are movable towards one another and, subsequent to forming a loop of garnishing material around said string part, by supplying said electrodes with high frequency energy so as to "fuse" the loop together around said string part. Naturally, one prerequisite in this respect is that the garnishing material can be caused to fuse or melt together under heat and pressure.

The periodic string parts onto which the garnishing material is attached may be located in some way or another, either in the transverse direction of the web material or in its longitudinal direction. The important criterion is that the string parts will conform to a pattern of apertures in the endless, rotating path, subsequent to having been drawn down together with the garnishing material and embraced by jaws which pinch together and are heated with radio-frequency energy.

The endless, rotating path preferably has the form of a cylinder, of which part of the mantle surface between two generatrices thereof take part in the work, a first part for taking-up the material, a second part for clamping together and respectively heating and cooling, the material and a third part for opening and releasing the material. The endless, rotating path may also have the form of a belt which rotates around rollers, wherein at least the opening and closing of the jaws for periodic string parts in the transverse direction can be achieved through the coaction of the apertures with hinge parts which open upon passage of the belt over a guide roller.

A suitable frequency for the high frequency energy is 27 MHz, a frequency which is permitted by the authorities for industrial use. Many other frequencies are possible from a technical aspect.

The invention will now be described with reference to non-limiting, exemplifying embodiments thereof. In the accompanying drawings.

BRIEF DESCRIPTION OF DRAWINGS

FIG. 1 is a schematic, total view of a preferred system for attaching garnishing material to a net structure. The Figure illustrates the working steps A–F:

Figure 1:
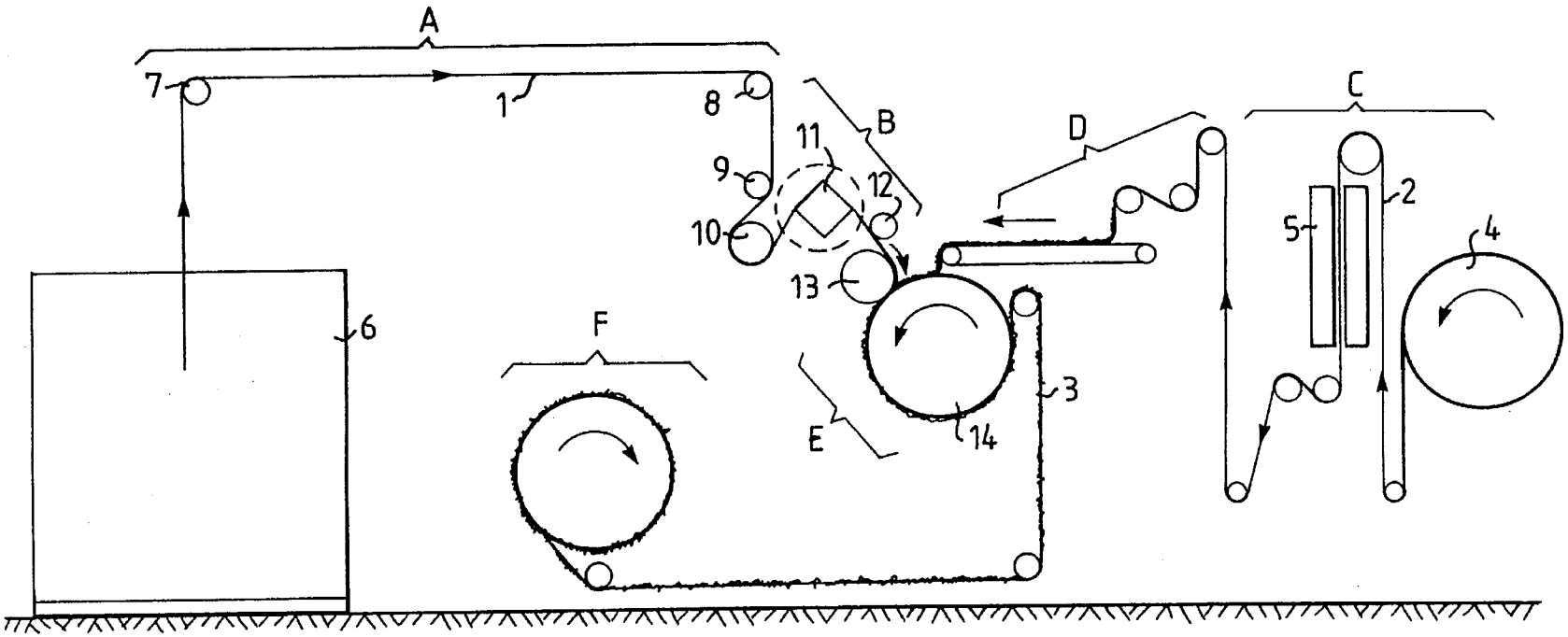
FIG. 1 is a general illustration of equipment used for fitting garnishing to a net structure.

At step A, net is collected from a box 6 and widened or spread. Such net is normally delivered in the form of a string, in which the borders or selvages are displaced towards one another through a distance corresponding to the width of the widened net, and hence all threads are stretched. Although not shown in the Figure, the box is actually located on one side, and the net is widened with the aid of rollers 7 and 8 which are positioned so that the net will have been essentially widened subsequent to having changed its transport direction through 90°. The net is then also stretched laterally with the aid of a tensioning roller 9 and a roller 10 which is a driven roller and is provided with helical raised portions, which are left-hand and right-hand threaded in respective individual directions from the centre.

In step B, the net is placed over garnishing material delivered to a welding drum. The net is then stretched slightly and passed over a wooden roll 11, the configuration of which is best seen from FIGS. 2 and 3 and which has frustoconical projections 110 having a square base (for nets of square mesh shape), these projections 110 being adapted in relation to the mesh size of the net. The roll 11 is braked. The net is drawn from the roll 11 by an insertion 13, via a grooved roll 12 in which the threads stretched in the path direction are accommodated, said insertion roll 13 coacting with a lifting-off segment 15. The insertion roll 13 is provided with pairs of capturing projections 130 which pass between pairs of lifting-off segments 15 as the insertion roll rotates. The threads of the net which extend in the path direction pass between the lifting-off segments 15 and between the capturing projections 130, these latter projections capturing the cross-threads of the net, so that the knots or net-ties in the net will be caught by the capturing projections. The insertion roll 11 now inserts the net-strings into apertures 140 located in a welding or fusing roll 114, this being made possible by the fact that movements of the insertion roll 13 and the welding roll 14 are mutually connected through a gear arrangement (not shown). As will be seen from FIG. 3, the cross-threads of the net are stretched by being drawn into the gap between pairs of capturing projections 130 as the roll 11 is retarded. Subsequent to inserting the net into the apertures 140, the knot locations are released from the capturing projections 130 of the insertion roll, in that the lifting-off segments 15 (FIGS. 2 and 3) prevent the cross threads of the net from accompanying movement of the peripheral surface of the laying-on roll, these segments pulling the net loose from said roll. As will be clear from the following, the net is now engaged in the apertures 140, which then close.

When placing the garnishing material in the apertures 140, the actual net threads will extend into the garnishing material, this material not always being flat but sometimes even provided with pleats or folds. The threads should thus be well stretched. In order to ensure that the threads are stretched, the insertion roll 13 is constructed with a pitch distance, measured in the circumferential direction, which is slightly larger than the nominal mesh measurement. This will ensure that the capturing projections will always engage the net behind a knot. Because the roll 11 is braked, engagement of the capturing projections with the net, and therewith advancement of the net, will take place automatically in steps which are determined by the actual periodicity of the net and irrespective of, for instance, deviations caused by manufacturing net tolerances included in the overmeasurement of the pitch distance, which can appropriately be placed at 15% of the nominal mesh measurement and therewith still afford a sufficient safety margin.

At step C in FIG. 1, there is simultaneously prepared a garnishing material in the form of a web 2 which is taken from a reel 4 and leaf-cut in a schematically illustrated punch 5, for instance in the manner taught by U.S. Pat. No. 3,069,796. This material is stretched in a controlled fashion to form a three-dimensional structure and is transported at D to the welding drum 14 and placed on said drum prior to the arrival of the net 1, which is thus placed on top of the garnishing material. The garnishing material is pulled into the apertures 140 by the net threads and is there fastened at step E in FIG. 1, as described here below. The finished product 3 is then stripped from the roll and rolled into roll form at F.

Figure 2:
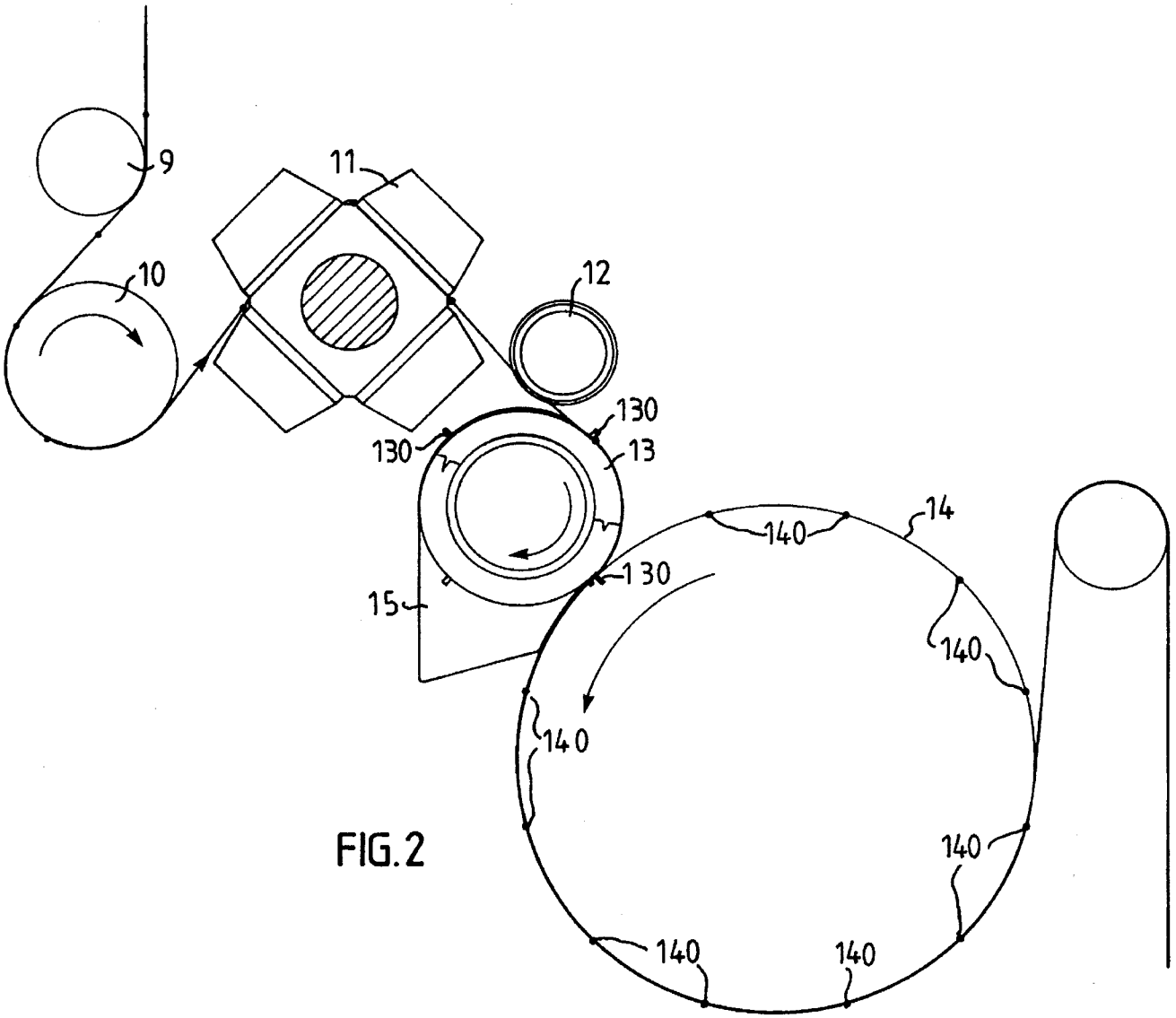
FIG. 2 is a side view which illustrates the manner in which a net web is developed or spread out, and inserted.
Figure 3:
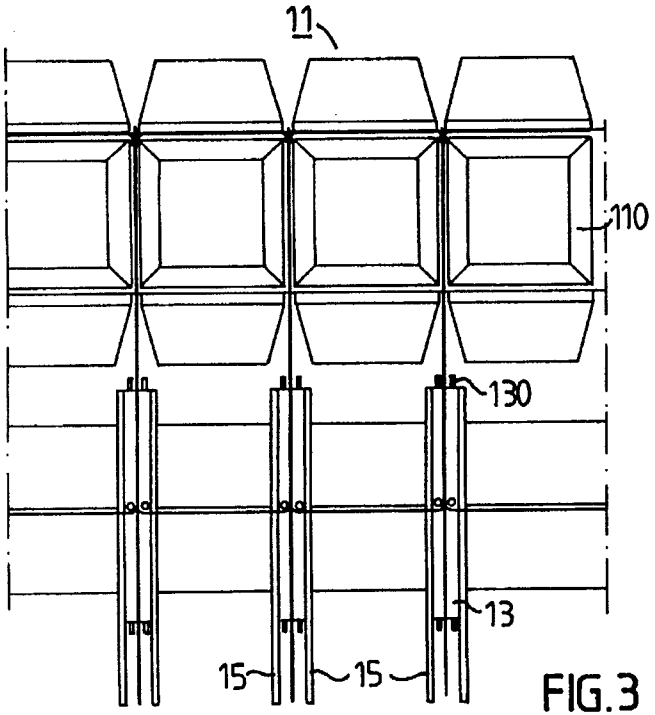
FIG. 3 is a front view of part of the FIG. 2 illustration.

The actual attachment operation is suitably described with reference to the apertures 140 indicated schematically in FIG. 2 and in which parts of the cross-threads of the net are inserted.

Figure 7:
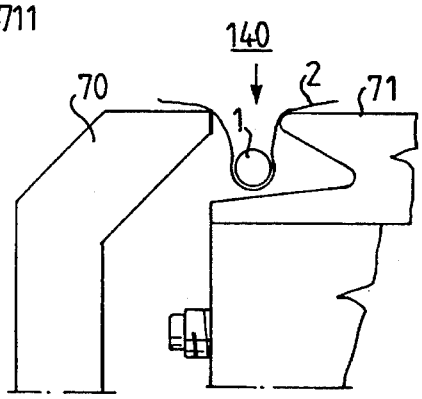
FIGS. 7 and 8 illustrate electrodes having string parts and garnishing material inserted therebetween during a respective insertion phase and welding or fusing phase.
Figure 10:
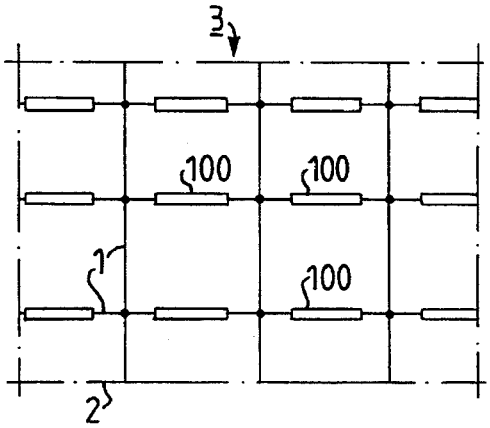
FIG. 10 illustrates a finished camouflage net from beneath.

When inserting the net, the apertures will have the cross-sectional shape illustrated in FIG. 7 and are defined by two electrodes 70, 71, between which garnishing material 2 has been drawn by the net threads 1. In a manner described hereinafter, these electrodes 70 and 71 can be brought together such as to press together two surfaces of the material 2 around a net thread which is embraced by the material. High frequency energy is then supplied between the electrodes 70, 71 so as to fuse the material surfaces together and therewith secure the garnishing material to the net thread. FIG. 10 illustrates part of such a net from beneath, with loops 100 which are fused together around string parts of the net, periodically and at separate locations.

Figure 4:
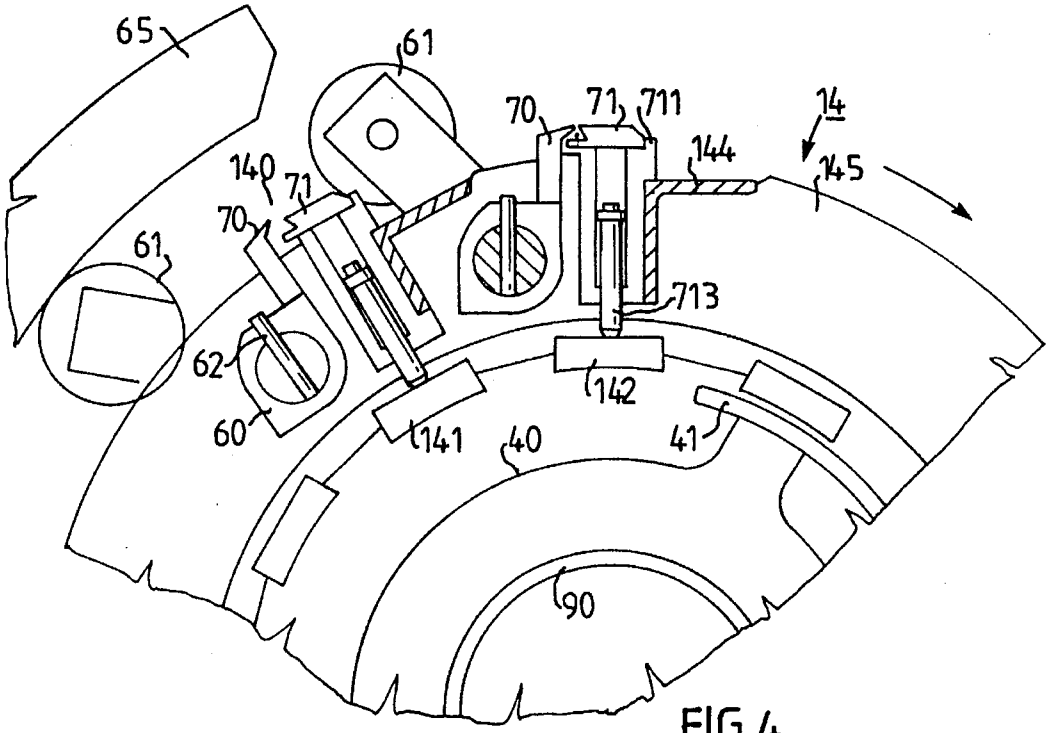
FIG. 4 is a part view in section illustrating a mechanism having closable electrodes.
Figure 5:
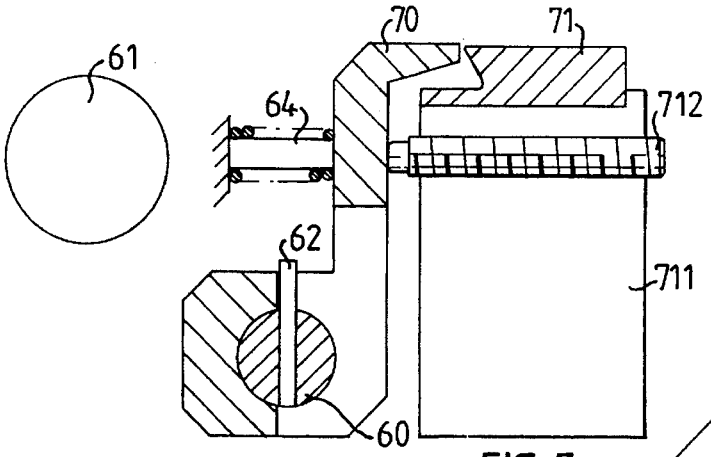
FIGS. 5 and 6 are respectively a cross-sectional view and a top view of the closable electrodes.
Figure 6:
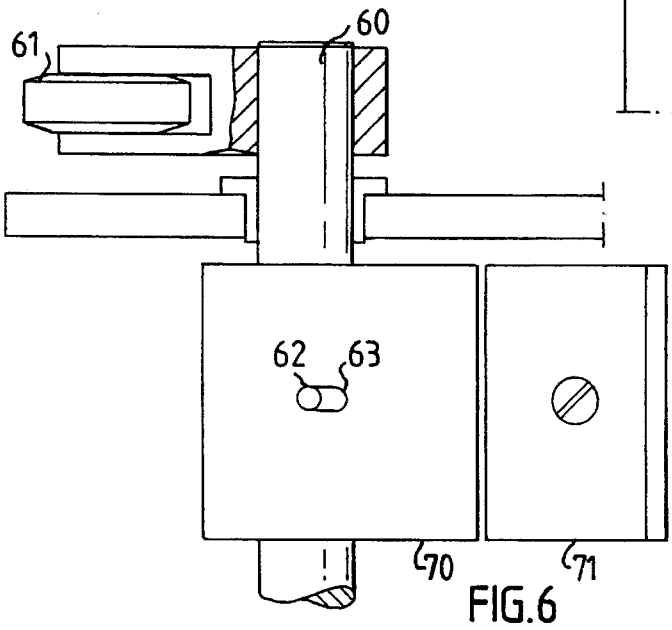
Figure 8:
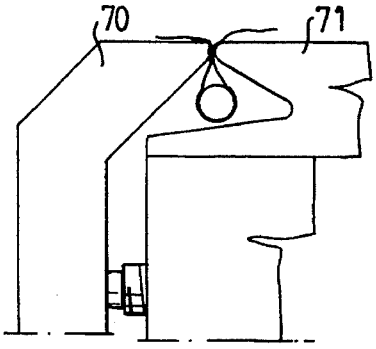

Manoeuvring of the electrodes 70 and 71 will now be described. The object is thus that the gaps defined between the respective electrode pairs are open when the insertion roll 13 (FIG. 1) inserts string parts of the net into said gaps or apertures, whereafter the electrodes are brought together and a high frequency energy is applied during part of one revolution of the drum 14, and that the gap is held closed in the absence of such energy supply over another part of said revolution, and are then again opened so as to enable the finished net 3 to be removed and rolled up at F. In the case of the described machine, this opening and closing of the electrodes is effected by a camming mechanism described below with reference to FIGS. 4, 5 and 6. It will be seen from the Figures that the electrodes 71 of each electrode pair are fixedly mounted to the drum, through insulating carriers 711. The electrodes 70, on the other hand, are attached to rotatable shafts 60 which extend over the whole length of the welding drum 14 and project slightly therebeyond, and to which roller devices 61 are mounted. These roller devices are operative, via a cam 65, to manoeuvre the shafts 60 to an electrode open position, as evident from the left-hand electrode pair in FIG. 4. When the roller devices 61 are not in running engagement with the cam 65, the electrodes 70 of each electrode part are urged towards the electrodes 71 by springs 64 to a maximum gap distance which, in accordance with FIG. 5, is determined by adjuster screws 712 on the carriers 711.

Although not shown, cams 65 are arranged both at the web intake position and at the web output position. It will be noticed that the electrodes 70 are not strictly mounted rigidly to the shafts 60, but that pins 62 pass through elongated holes 63 in the electrodes 70. Thus, although the distance between the electrodes 70 and 71 in the electrode gap will have a minimum distance determined by the stop screws 712 (see FIG. 5), the electrodes can move away resiliently under the action of the spring 64 to the vicinity of a maximum distance determined by the holes 63. In view of the fact that a leaf-cut material of double thickness may be inserted inadvertently in the gap or aperture defined by the electrodes, or that the thread 1 (FIG. 7) falls opposite a hole in the garnishing material 2, this arrangement will provide a satisfactory function under all circumstances, even with such irregular garnishing material.

High frequency energy is supplied to the electrodes 70, 71 in the following manner. Because of their construction, the movable electrodes are earthed to the machine frame and incur no difficulties at the frequencies applied. The electrodes 71 are attached to insulating carriers 711. As will be seen from FIG. 4, the carriers have arranged therein spring-loaded transfer pins 713 which make contact between the electrodes 71 and pick-up or delivery rails, such as rails 141, 142 in FIG. 4. These pick-up rails rotate together with the drum 14.

Figure 9:
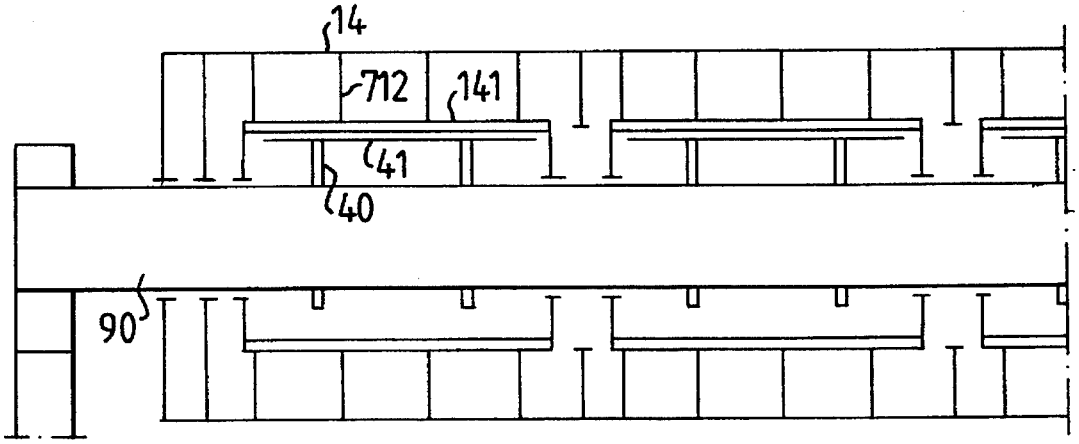
FIG. 9 is a sectional view of a welding drum.

FIG. 9 illustrates schematically a section of the drum 14 and the high frequency supplied from the inside of the drum. Located innermost in the drum is a stationary, tubular shaft 90 which is affixed to the machine frame at both ends thereof (only one end is shown). Fixedly attached to the shaft 90 is an insulating hub 40 which supports over a part of its circumference, over which high frequency energy shall be supplied, an electrode 41 of circular, arcuate cross-section. Because the electrode is stationary, no difficulty is experienced in supplying energy thereto. The supply of energy is effected from the inner surfaces of the tubular shaft 90 and the electrode 41 is accessible from the ends of the shaft through holes (not shown) provided therein. When the pick-up rails, such as rails 141, 142, pass close to and outside the electrode 41, power is transferred capacitively to the pick-up rails and from there to the electrodes 71 through a conventional ohmic conductor and the transfer pin in 712. The reason why the pick-up rails are attached to a separate hub and are not attached to the drum, is that it is desired to be able to check the distance more readily between the pick-up rails and the electrode 41, particularly since the hub with the delivery rails can move substantially unloaded. This is particularly beneficial when working with large widths.

In the case of the illustrative embodiment, the drum 14 is constructed of bars 144 which are placed along generatrices, and of flanges 145 placed in radial planes. Corresponding flanges at the ends of the drum provide bearing means around the stationary shaft 90. The flanges are duplicated at the ends of the drum, for the purpose of attenuating radio frequencies.

As will be seen from FIG. 9, the supply of high frequency energy is divided into sections in the axial direction of the drum 14. In the case of a tested construction with a path width of 1.7 m, five such sections were arranged in the axial direction, and each of the sections was supplied with 5 kV through a respective 50 Ω coaxial cable. The pick-up rails, and therewith the rows of electrode pairs, were 12 in number, of which six were covered by the electrode 41. The plant was constructed for nets having a nominal mesh size of 85 mm and the electrodes 70, 71 had a length of 56 mm. Each row contained 20 pairs of electrodes. The power load for the high frequency energy of 27 MHz was about 300 W per section.

FIG. 10 illustrates schematically a finished camouflaged net 3, where garnishing material 2 has been attached to the net by means of loops 100 which embrace the net threads. The net is seen from beneath and, although not clearly evident from the Figure, the other side of the camouflaged net has loosely placed thereon garnishing material 2 which protrudes outwards to produce a satisfactory three-dimensional effect, which is thus particularly noticeable when the material is leaf-cut and/or applied with a controlled surplus in the length and/or width direction. Both good attachment and a good three-dimensional effect are achieved as a result of looping the garnishing material at separate locations and fastening the loops to the netting.

Figure 11:
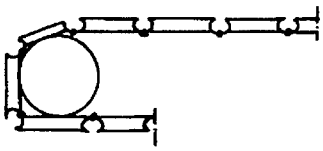
FIG. 11 illustrates schematically an alternative construction of an endless, rotating path corresponding to the welding drum.

In the above description of an exemplifying embodiment of the invention, the rotating path on which the electrode pairs are mounted has the form of a cylindrical drum. It will be understood, however, that this path may have some other configuration, for instance the configuration of a conveyor belt with hinged segments, as illustrated in FIG. 11, the connecting parts of which open as the belt passes over a guide roller but which close in planar belt sections, wherein pairs of electrodes are mounted along the hinge line. This is but one example of many variations that are conceivable within the scope of the invention as defined in the following claims.

We claim:

1. A camouflage net which comprises a framework of net material (1) and a foil which includes garnishing material and which is attached at least intermittently to said net material from one side thereof, characterized in that the garnishing material is attached to the net material by intermittently laying the garnishing foil in loops around yarn parts of the next material and by mutually joining together the thus formed loops at their beginning and end, as seen in relation to respective yarn parts.

* * * * *